US006536716B1

(12) United States Patent
Ireland et al.

(10) Patent No.: US 6,536,716 B1
(45) Date of Patent: Mar. 25, 2003

(54) CONVERSION THROTTLE INTERFACE FOR MODEL RAILROADS

(76) Inventors: Anthony J. Ireland, 97 Park Dr., Norcross, GA (US) 30071; Hiroshi Kato, 1-30-15 Nishi-Ochiai, Shinjuku-ku, Tokyo (JP), 161-0031

( * ) Notice: Subject to any disclaimer, the term of this patent is extended or adjusted under 35 U.S.C. 154(b) by 7 days.

(21) Appl. No.: 09/981,266

(22) Filed: Oct. 17, 2001

(51) Int. Cl.[7] ..... B61L 3/00

(52) U.S. Cl. ..... 246/187 A; 246/167 R; 246/187 B; 246/182 R; 340/825.52

(58) Field of Search ..... 246/3, 5, 167 R, 246/186, 187 A, 187 B, 182 R; 104/295, 301; 701/19; 318/51, 280; 340/825.52, 825.21; 307/125; 446/7; 434/62

(56) References Cited

U.S. PATENT DOCUMENTS 5,448,142 A * 9/1995 Severson et al. ..... 318/280
5,456,604 A * 10/1995 Olmsted et al. ..... 434/62
5,480,333 A * 1/1996 Larson ..... 446/7
5,773,939 A * 6/1998 Severson et al. ..... 318/51
5,999,863 A * 12/1999 Lin ..... 701/19
6,267,061 B1 * 7/2001 Katzer ..... 105/1.5
6,281,606 B1 * 8/2001 Westlake ..... 307/125

OTHER PUBLICATIONS

Dr. Tom Catherall—Digital News Letter, vol. 4 No. 3 pp. 1 to 4, May 1992, titled "Delta".

* cited by examiner

*Primary Examiner*—Mark T. Le

(57) ABSTRACT

A method of providing a new control capability to a conventional current control device connected to a model railroad control system includes the use of a conversion interface devices and a throttle user interface device. The conventional current control device and the interface devices are arranged and configured in a manner to allow exporting the new control capability from the throttle user interface device to the conventional current control device so as to transform the conventional current control device into a conversion throttle that is capable of the new control capability.

16 Claims, 2 Drawing Sheets

CONVERSION THROTTLE INTERFACE FOR MODEL RAILROADS

BACKGROUND OF INVENTION

Figure 1:
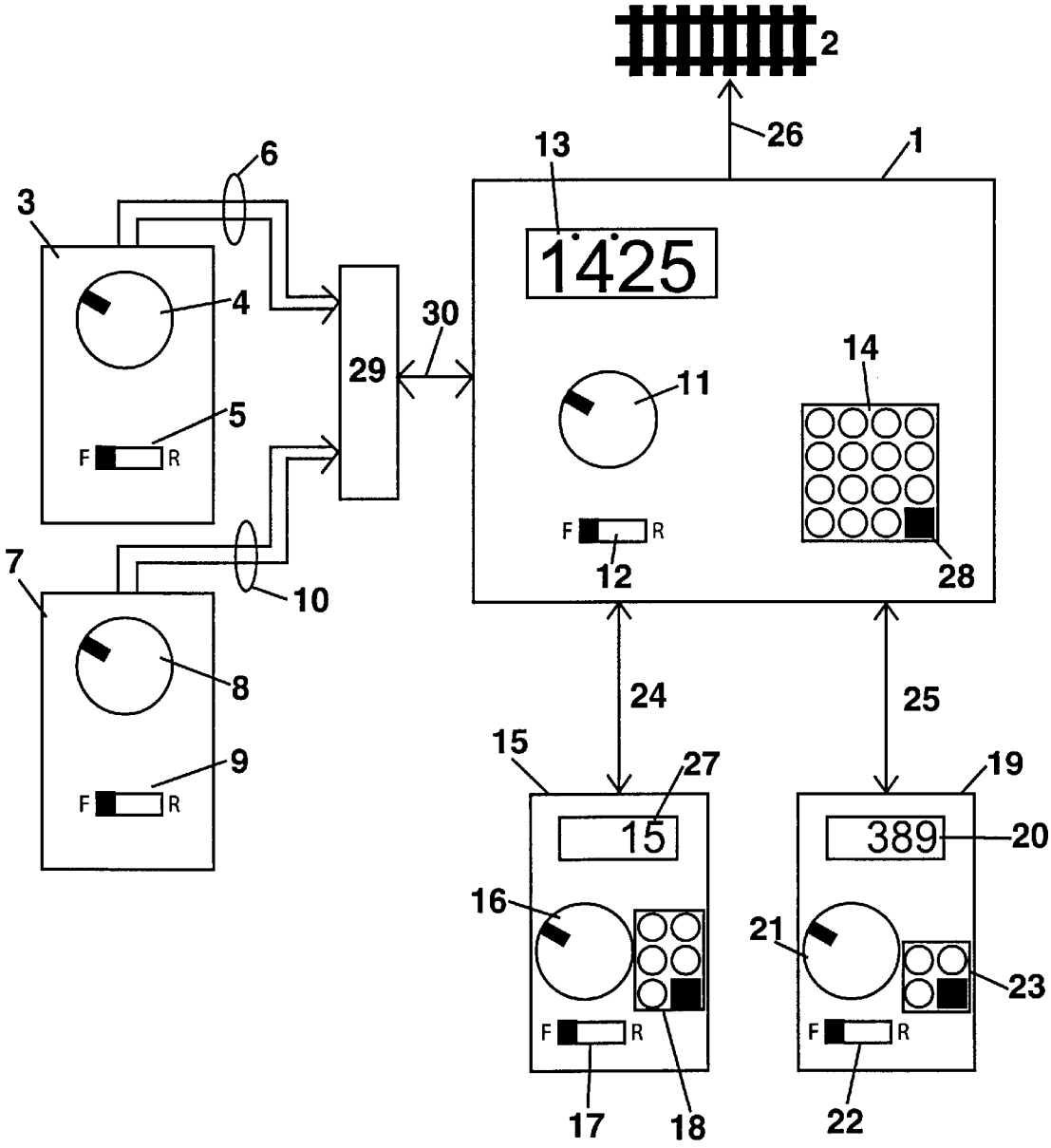

This invention pertains to the field of control systems for scale model railroad layouts, and specifically to improvements in low-cost user throttle devices.

The rapid growth of the control of model railroad layouts by Digital Command Control, DCC, or other multiple train control schemes such as taught by Palmer in U.S. Pat. No. 4,335,381 and Lahti in U.S. Pat. No. 4,341,982 have increased demands for user input or control devices that are often termed "throttles" or controller units.

Since Command Control schemes permit concurrent multiple train operations with multiple persons controlling one or more locomotives or trains, it is usual for layouts to employ from a couple, to dozens of throttles when in operation. Complex layout control systems often employ many expensive throttles along with other system enhancements such as; expanded power boosters and fault control, signaling and occupancy detection, transponding, attached computers and even sound systems. Each of the controlled locomotives or control output devices attached to the layout has an addressable decoder device to detect the commands encoded and transmitted to it by the multiple train control system, and then executes the desired command, such as locomotive motor control etc.

A particular problem is creating multiple train control or command control systems where the cost of the control equipment is less than a budgetary constraint for novice users of these new technologies. Here a minimum system would be initially configured for train control with a single throttle. Addition of a second or more throttles is then a large extra expense to obtain the full benefits of multiple train operations.

In February 1992 at the Nuremburg Toy Fair, Marklin GmbH introduced the novel concept of the "Delta System" that was tailored to provide a compatible and less expensive control system, with reduced features, compared to their more complex earlier "AC Digital" or "Motorola/Trinary" digital system.

The Marklin Delta system can deliver a digital multiple train control system at a lower cost by employing an existing European style variable throttle alternating current (AC) power transformer or power pack. This provides both input power to operate a Delta 6604 digital control unit and the conventional variable 16-volt AC train control voltage of the transformer unit is used as a speed controller. In this way, the 6604 Delta module is added to a standard European 16-volt AC train control transformer unit to create a hybrid digital multiple train control system. In this hybrid system, reversal of direction is commanded by using the higher voltage AC pulse (up to about a 40 volt peak) that is normally used to reverse European 16-volt AC motored locomotives. The Delta 6604 control unit simply has 4 selectable locomotive addresses and two stop positions. Note that the 6604 unit has no inherent throttle capability but just acts to select one of a very limited set of four address numbers #24, #60, #72 and #78. The Delta 6604 controller has no other control features, but a second "walk-around" 6605 passive Hand controller unit or throttle with a permanently fixed locomotive address #80 may be connected to the controller to provide speed and direction control for second train operation with just locomotive address #80.

The Delta system thus allows a low-cost multiple train control capability to be created but does not allow: expansion of user controllable functions such as lights or sound units in each locomotive, the selection of any address within the range configurable in any compatible locomotive decoders, the forming of consists (the linking or unlinking of multiple different address locomotives into a single controlled train address), or the use of a non-AC type of train control unit as the primary throttle. Additionally, the Delta 6604 is inoperable as a stand-alone control unit and has to have the European style variable AC power transformer added to create a functional system.

In contrast to Europe, the most common form of conventional, or non-digital, model train control in the United States are in fact variable voltage direct current (DC) power packs or throttles, where the power pack output polarity is used to control direction and the voltage level controls speed of DC motored locomotives.

A passive throttle interface has been provided as a fixed address #00 Analog throttle on the Wangrow Electronics "System One" Command Station, introduced in 1994. In this application, a simple specific potentiometer or network of passive devices is attached via a dedicated cable to pins internal to the Command Station. This passive throttle then allows a user control of speed and direction for fixed address #00 (the address often used to describe the control of an NMRA Analog DCC or non-decoder equipped locomotive). This application offers no control capability other than speed and direction with the passive throttle, even though the System One command station itself supports advanced features such as function control, access to a full range of DCC addresses, and items such as formation and control of consists. Thus, this is a passive, very simple and limited throttle.

In 1993 Digitrax introduced the low cost "Challenger" DCC system where the user throttle was a CT4 hand controller with four rotary speed control knobs. This system used a novel combination of passive elements in the four control lines from the throttle to create different DC voltage levels that singly, and in combination, encoded four speed and direction channels, a mechanism to select from a limited subset of 16 possible DCC addresses (from #00 to #15), and a key to control locomotive lights, or function FO. Additional functions F1 to F12 and addresses above #15 are not accessible. The matching DB100 control unit is used to power the track, but is not operable without the CT4 throttle to provide control inputs from a user. This is a further example of a limited passive external throttle connected to a control unit. Again, this passive throttle does not access all the possible common features of DCC control systems, although the CT4 throttle is itself capable of very limited locomotive address selection.

Note that these last two passive throttles provide no power to the system, but rather are powered by them and have no alternative control utility such as a DC power pack may have when just controlling a conventional DC layout. By contrast, a command control or digital throttle type is considered active in that it has a control or communication interface that encodes digital data for transmission to the control system, and is not limited to signals conveyed by the simple voltage levels of a passive throttle.

A valuable improvement over the prior art is the creation of a multiple train control system that permits the use of DC or other conventional power packs as low cost conversion throttles, and that also offers augmented control features to these conversion throttles. This would overcome many of the limitations of the prior art, such as offering the ability to address the full range of possible locomotive addresses, control of functions and formation of consists, not possible with that prior art.

SUMMARY OF INVENTION

This invention improves on the prior art by allowing surplus or superseded older power packs or direct current control devices to become conversion throttles that then have simulated features associated with them that are comparable with the user interfaces of digital throttles.

Digital throttles perform at least similar functional speed and direction control of locomotives that older power packs do for conventional locomotives, but additionally, usually have at least a user interface with a locomotive address selection mechanism, and/or function controls and other advanced features. These extra features of the user interfaces of digital throttles are not an inherent, possible or native capability in older power packs or direct current control devices.

To gain this valuable user interface conversion or simulation capability, the user interface of a digital throttle is "exported" or associated with a particular power pack or direct current control device that is then considered to be termed a conversion throttle. This association method allows a unique and arbitrary locomotive address selected by the digital throttle user interface, or other control capability to be given, or transferred to a conversion throttle. Once this transfer, or export, of a locomotive address is completed, the digital throttle may then be released from exporting and recall its prior address or be used to select a different address and control that next locomotive. Meanwhile the conversion throttle continues to control the exported locomotive address.

The key capability and value of this novel arrangement is that, during the export phase, the full control capability and features of the digital throttle performing the export is available to, and is associated with, the conversion throttle. This means the conversion throttle, which is normally limited to speed and direction control, can enjoy the benefit of having associated features like: address selection, function control, forming locomotive consists and other features that it has no native capability to perform.

In effect, all the control capabilities of a source digital throttle are transferred or mapped to the destination conversion throttle except for speed and direction control which is maintained by the speed and direction control setting of the destination conversion throttle. In the system the appropriate destination conversion throttle state or control information is loaded from the exporting or source digital throttle. This capability is very useful and practical since the majority of control of any active locomotive on the train layout is typically just speed and direction, which are always available as a native capability from the power pack or control device that is being converted. This is particularly the case for all model railroad layout control devices in the decades prior to the expanded features offered by modern multiple train control systems.

Accordingly, the majority of operating time for the conversion throttle is simply as a speed and direction control. The output leads of the conversion throttle are simply connected to the appropriate conversion interface in the system and the control output voltages of the conversion throttle are measured and calculated as the desired speed and direction. This information is then combined within the control system with the previously exported and associated (locomotive) state information to then control units on the layout. A digital throttle is thus not burdened with any tasks for the majority of the time when the conversion throttle is just controlling speed and direction. The export of control information to the conversion throttle can be viewed as a temporary transfer of the user interface of a digital throttle to augment the user interface and state information of a particular conversion throttle. While this transfer is in effect, it is possible to select any desired locomotive address, form consist links and unlinks of multiple locomotives in a train, as well as offer any other complex capabilities that the digital throttle may possess. Units controlled on the layout by throttles need not only be mobile locomotives. For example, a static digital scale-model crane with functioning boom, winch etc. can be controlled using the locomotive speed, direction and function control capability.

If temporary control of a function is needed for a conversion throttle controlled locomotive, for example a sound function actuation to blow the whistle, it is possible for the digital throttle to be briefly exported again to the particular conversion throttle to offer this control capability.

Note that when the digital throttle is used in this way it can "import" or reload from somewhere in the system the present state information for the conversion throttle and only change the state of a feature requested by direct input from the user interface. In this manner the changing or export of the locomotive address to a conversion throttle can be differentiated from the actuation or modification of any other control features. This allows a selective and orderly access to any desired set of conversion throttle features from any other digital throttle with export capability that may be connected to the system. This distributes and enables powerful conversion throttle control throughout the whole system.

While a digital throttle is importing, modifying a control feature and then re-exporting this changed information to a conversion throttle, it is sensible for the state of any prior locomotive that the digital throttle may have been controlling to be saved and then automatically restored when conversion throttle export activity is completed. The duration of external control influence on a conversion throttle may be distinctly set by user action or automated by a mechanism such as a timeout or similar action.

Obviously the needed state information for any conversion throttle resides within the control system or even a digital throttle, since it cannot be embedded in the pre-existing power pack or direct current control device that is to be used as a conversion throttle. The contribution that the power pack makes to the conversion throttle synthesis is simply its native speed and direction control capability.

ATTACHED DRAWINGS (2 sheets)

FIG. 1 details the typical physical arrangement of the elements of the preferred embodiment.

Figure 2:
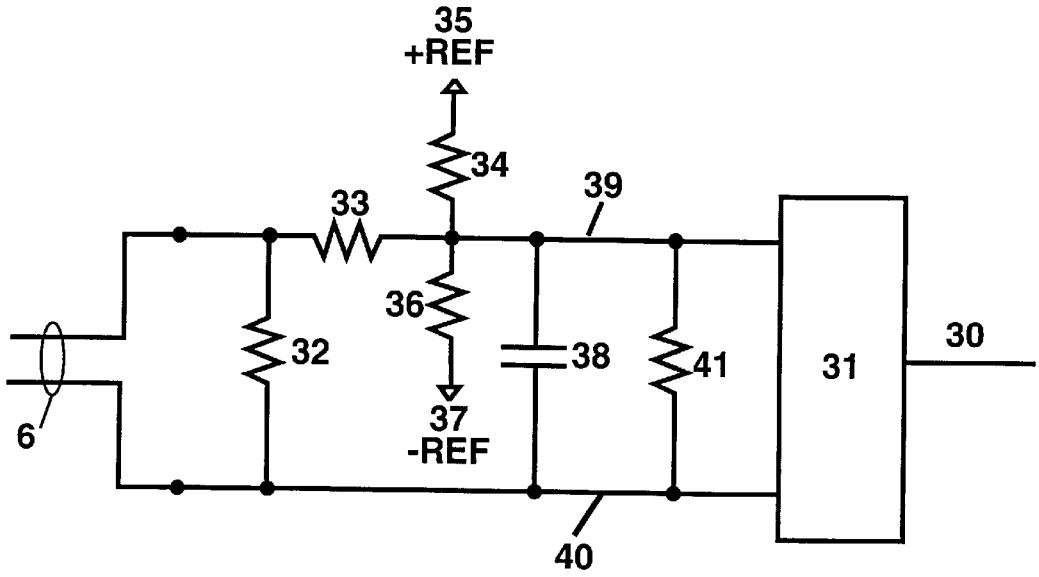

FIG. 2 details an electrical schematic of the conversion interface for the preferred embodiment.

Figure 3:
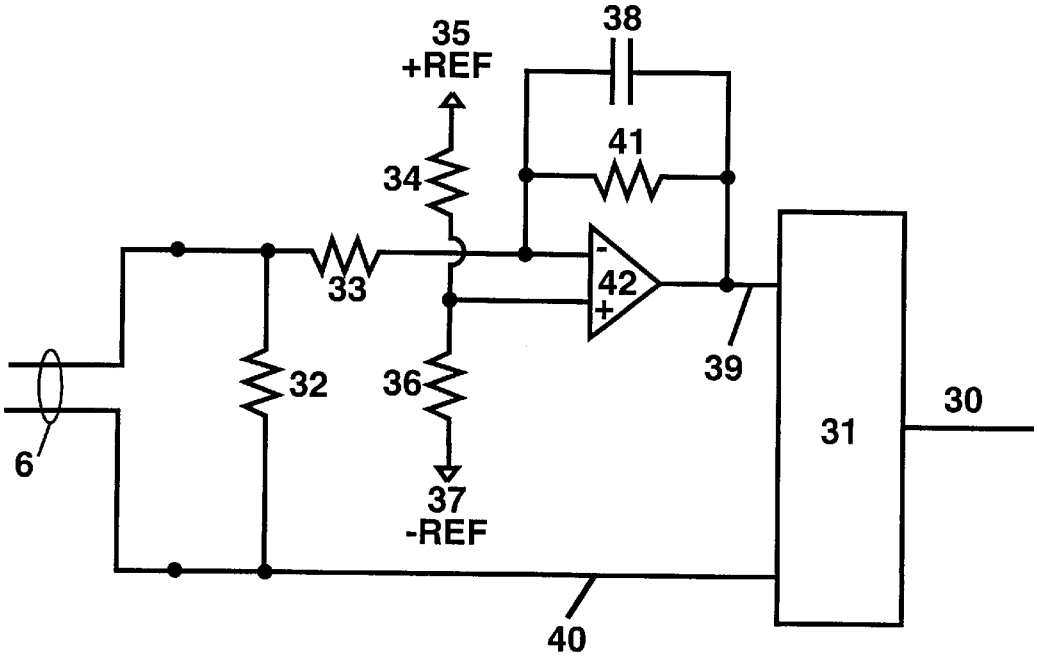

FIG. 3 details an alternative electrical schematic of the conversion interface for the preferred embodiment.

DETAILED DESCRIPTION OF INVENTION

FIG. 1 depicts the key elements of the physical arrangement of the preferred embodiment of the invention. Item 1 represents a multiple train control capable system control unit that encodes and generates appropriate layout control voltages and communicates these via output connection 26 to the model railroad layout tracks, 2. The actual control voltage encoding method used for layout control is not critical to this invention and may include any control formats used for multiple train control on the same layout tracks. Item 1 converts any throttle state information within the system to appropriate layout control voltages.

Items 3 and 7 represent one or more power packs or other control devices that become conversion throttles by using the techniques presented herein. Items 3 and 7 incorporate at least a throttle speed control means, shown as rotary knob items 4 and 8, and direction control means shown as slide switches items 5 and 9. Some power packs may have a number of other refinements such as; a braking control, momentum controls, power controls, maximum speed limit adjustments, displays such as voltage and current meters and other user status indicators. All these refinements have no bearing on the usage of these power packs or units as conversion throttles, since the only information considered is the speed and direction state information that is encoded by their output.

Note that the speed controls may be equivalently implemented other than the rotary speed knob shown in FIG. 1; such as a linear slider control or as speed up or down change switches or any other speed control method that affects the control function. The power pack direction switches are depicted with an "F" or forward direction position and "R" or reverse position in FIG. 1. Direction implementations may be by a different type of control than shown in FIG. 1, such as; a direction toggle switch, a momentary reverse switch, being incorporated in the speed control knob action, a multi-position lever arm, a control with other positions such as a brake function or multiple switches with other features such as East/West direction, but all these variations are considered to be equivalent and within the spirit and scope of this invention.

FIG. 1 does not explicitly show the power source for items 1, 3 and 7 and these are commonly and conventionally provided individually to the units by a wall connected power source or other energy source, such as batteries or similar. All the elements in the system could share a single energy source or be independently powered and the exact power configuration does not affect the scope or utility of this invention.

The outputs of units becoming conversion throttles, 3 and 7 are each conducted by at least two wire circuits, 6 and 10, to the appropriate input voltage interface connections on a conversion interface, 29. The system can provide a single or multiple instance of conversion interface 29, each with one or more voltage inputs. These interfaces may be explicitly built into a system control unit, 1, or be individual modules that communicate via a link or network, 30, to the system and system control unit, 1. Conversion interface, 29, analyses the voltages presented from a conversion throttle, interprets the control meaning and then conveys this speed and direction information to the system control unit, 1, and rest of the system, for control purposes.

Time variations of input voltage, such as voltage pulses or polarity reversals may be utilized by 3 and 7, as well as DC voltage polarity, to convey direction information. This may also include high voltage AC motor reversing pulses, or a progressive forward-neutral-reverse-neutral-forward cycle employed by conventional 3-rail Lionel AC locomotives by using voltage dropouts of "ZW" model control transformers. Timed voltages may even be used to encode other actions like those taught by Severson in U.S. Pat. No. 5,940,005. FIG. 2 is a detail of the conversion interface, 29, that shows input connection elements along with a conversion decoding logic, 31, that measures and processes the input voltage data to be suitable for inclusion as speed and direction state information for the conversion throttle.

The conversion decoding logic, 31, is arranged to provide the needed detection and measurement, decoding functionality and any state interpretation that may also be encoded by any input voltages, including the dimension of time. The needed state information of each conversion throttle may be conveniently maintained in the associated conversion decoding logic, 31, or within the system control unit, 1. This throttle state information, such as; speed, direction, functions state, consist links, etc. may be freely exchanged and modified as needed for the export function within the system by; system control unit, 1, or even digital throttles such as items 15 and 19 or any other device connected to the system.

In the most compact system, the system control unit, 1, may incorporate its own integrated digital throttle capability. Items 11 and 12 represent an integrated speed control and direction control function, item 14 represents a keypad or switch input arrangement for user input, and item13 represents a display area that shows status information using numeric or alphanumeric characters, symbols, icons, flags or any useful combination of these display elements. FIG. 1 shows display area item 13 indicating the integrated digital throttle is controlling locomotive address "1425", and other symbols in the display area show status of other features. In this way items 11 through 14 allow a digital throttle and all its control features and user interface to be implemented in a compact system.

Additional digital throttles 15 and 19 are shown to indicate that the system may be expanded easily, and it is intended and sensible that any digital throttle in the system may be configured to also allow export to, or control of, conversion throttles. In a very low cost system if items 11 through 14 are not provided in the system control unit, 1, then clearly an added digital throttle 15 or 19 can be used to perform the conversion throttle function.

System connections from system control unit, 1, to digital throttles 15 and 19 by items 24 and 25, and conversion interface, 29, by item 30 may be made by any of the standard interconnection techniques, wired or wireless, known to those practicing the art of data communications or control system design.

Since any of the digital throttles may be configured to export to or manipulate state information for the conversion throttle, the following detailed description will be given for the shown integrated digital throttle, items 11 to 14. This methodology may then obviously be applied to other digital throttle implementations, as needed.

The integrated digital throttle of system control unit, 1, is at least capable of selecting a locomotive address from the range available to decoders in locomotives that can run using the control voltage encoding method used for layout control of the tracks, 2. This may be by using the keyboard 14 to allow the direct selection of a number, scroll through the address range or even use the speed knob 11 as a selection user interface device. The actual user interface for this is not important, just the fact that the digital throttle can select a locomotive or layout device address. Additionally the keypad or switch input arrangement 14 may be used to control locomotive decoder functions, allow selection of multiple addresses to form a consist link or unlink, and other control features.

An important feature on this invention is the inclusion of a key or actuating device, export select 28, that is used to explicitly invoke or trigger the export of the digital throttle user interface to a particular conversion throttle. The actuation of export select 28 signals that the subsequent control, address selection, consist formation or other features are now to be considered to be exported or associated with a particular conversion throttle and its state information. The conclusion of this export-controlling period may be signaled in any convenient manner, such as: a second actuation of export select 28 to toggle out of export mode, an extra and dedicated export termination key or a timeout or any other actuation input. The provision of the export select 28 initiation as a separate actuation from any other digital throttle control input is vital, to allow the full range of user interface to be unambiguously tendered, exported or offered to a conversion throttle.

A unique export select actuator item 28 may be provided explicitly for each available conversion throttle, or the selection of each available conversion throttle may be sequenced through on each export select 28 actuation, or some other convenient equivalent method may be used. If selection is sequential, then subsequent actuations of export select 28 advances export to the next available conversion throttle and ends the export of the user interface to the current conversion throttle. A digital throttle being used to export may also be configured so that export mode is inherently triggered with a convenient and pre-defined sequence or action of the digital throttle user interface.

It is advantageous to maintain the same user interface control sequences and methods when in the export mode. This ensures minimal user confusion. However, it is also possible to create new control sequences that are only applicable when in the export mode. The range of user interface features available during export may be a sub-set, super-set or different set of capabilities of the digital throttle. For example, the entry into export mode for a single conversion throttle may be configured so that the address active in the digital throttle is then automatically transferred to or made to be the new locomotive address of the conversion throttle.

The additional digital throttles 15 and 19 are depicted as variations of the integrated digital throttle within system control unit, 1. They both incorporate display areas, 27 and 20, speed controls, 16 and 21, direction controls, 17 and 22, and actuating key arrangements, 18 and 23. The variations are to indicate that the system may have digital throttles with a variety of different types of user interfaces and controls, but all of these digital throttles can be employed successfully with this invention. In particular, actuating key arrangements, 18 and 23 would obviously each include a key or actuator dedicated to triggering the export capability. Display areas 27 and 20 show different address numbers and also numbers of digits, to indicate that digital throttles may have differing display areas and active address ranges, such as 2,3 or 4 decimal digit addresses. In some digital throttles the address display may in fact be indicated by the physical position of selection switches that are part of items 18 and 23 and not by a separate numeric display.

FIG. 2 details aspects of the preferred embodiment of the conversion interface means, 29. Connection 6 is used to communicate a.voltage sample from the power pack intended to become a conversion throttle, 3, to conversion interface load impedance 32. This load impedance is selected to assure correct operation of item 3, since some unloaded power packs have unstable or noisy output voltages, and the unloaded output may not decay to zero volts when the power pack is in the stopped position. A sensible value for 32 may be a resistor of a few thousand ohms, but depends on the power packs used. Item 32 may be deleted with some power packs.

The arrangement of impedances 33, 34, 36 and bias voltages 35 (+REF) and 37 (−REF) are employed as a means to mix and translate the input voltage range of connection 6 to a favorable mixed input voltage range between the input sample node 39 and common node 40, or across the filter network provided by capacitor 38 and impedance 41. The mixed input sample voltage between node 39 and common node 40 are then conducted to the conversion decoding logic, 31, for measurement and further processing. The arrangement shown of elements 33 to 41 may be modified by one skilled in the art of electronics, to an arrangement that is functionally equivalent by using, for example, an active operational amplifier configuration.

FIG. 3 is provided as an illustration of one of these possible variations of FIG. 2, and the same item numbers, with the addition of an operational amplifier, 42, are used in equivalent ways to minimize confusion. Thus, the mixing means that is employed to translate the input voltage to a favorable mixed input sample voltage may be different from that shown in FIG. 2, but still be equivalent and be within the spirit this invention.

The following discusses the functions of conversion interface means, 29, and is based on the circuit arrangement presented in FIG. 2.

The input voltage sample from power pack, 3, is developed across conversion interface load impedance, 32, and is mixed by impedance element 33 into input sample node 39. The bias voltages 35 and 37 and the combination of impedances 34 and 36 serve to also mix a zero offset bias voltage into input sample node 39 that predefines the voltage seen when the power pack, 3, is at stopped position or zero voltage. For example, if item 33 and 41 are 47 kilohms, items 34 and 36 are 10 kilohms, 35 is at +5 volts DC, 37 is at 0 volts DC, then with zero volts across impedance 32 the input sample node 39 will be at about +2.06 volts for the circuit of FIG. 2.

Now a negative 20 volt input across impedance 32 will change input sample node 39 to less than +1 volt. A positive 20 volt input across impedance 32 will change input sample node 39 to more than +3 volts. In this way, the large bipolar range of voltages possible from the power pack, 3, are attenuated and offset to provide a voltage range that is convenient for measuring electronics that operate in the range of 0 to +5 volts DC. The actual values for 32 through 37, and 41, may be modified from those given to allow different amounts of attenuation, zero offset bias voltage, input voltage range to be chosen, as well as slight gain differences when using an operational amplifier implementation.

Conversion decoding logic, 31, may employ any of the many well-known voltage measuring means to measure the mixed input sample voltage between nodes 39 and 40, such as an analog to digital converter or a voltage to frequency converter. The conversion decoding logic, 31, uses this measurement of the voltage magnitude to determine the speed setting of power pack, 3. Capacitor 38 is employed so as to filter high frequency noise from any voltage measurement.

The direction for a DC type power pack, 3, is determined from the polarity of the input voltage, i.e. whether the mixed input sample voltage is greater than +2.06 volts (positive or forward) or less +2.06 volts (negative or reverse). The relationship of voltage polarity to direction is chosen for convenience, and can be the opposite case. It is useful to choose a voltage guard band around the chosen +2.06 V zero offset bias voltage. Any voltage within this guard band is considered to be a stop condition and no direction changes are decoded. This ensures that component tolerance and power pack output leakage will still allow a reliable stopped state to be decoded and that the measured direction is stable at very low speeds. A sensible guard band would be approximately 1% to 10% of the mixed input voltage range.

If power pack, 3, is an AC voltage type, the peak voltage magnitude encodes speed, and; a high voltage AC pulse, sequenced voltage dropout or other time variation may be used to encode direction change. The conversion decoding logic, 31, is configurable to correctly process the type of AC direction encoding that is to be used. For AC power packs the voltage measurements are performed to find the peak values on a waveform that may be 50 or 60 Hertz AC.

A sufficiently fast analog to digital converter may be employed along with supporting decoding logic to automatically analyze the voltage waveform to determine if it is AC or DC, and the maximum voltage seen. An AC waveform will have both positive and negative input voltage cycles, and a DC waveform may be a steady DC voltage or a series of duty-cycle variable unipolar voltage pulses. This allows the interface of FIG. 2 to be used automatically with no modifications for either an AC or DC type of power pack, so a single conversion interface and product can work interchangeably with any style of power pack.

What is claimed:

1. A method for providing a new control capability to a direct current control device without said new control capability, and said direct current control device being connected to a model railroad control system, said method comprising the steps of:

providing said direct current control device without said new control capability, and said direct current control device including a speed control means, a direction control means that encodes a direction by a DC voltage polarity of an output voltage of said direct current control device, connecting said output voltage to a conversion interface means for detecting and processing said output voltage, transmitting the detected and processed output voltage from said conversion interface means to a throttle user interface means that is capable of performing said new control capability, exporting said new control capability from said throttle user interface means to said direct current control device so as to transform said direct current control device into a conversion throttle that is capable of performing said new control capability.

2. The method defined in claim 1, wherein said step of exporting is initiated by an export select means.

3. The method defined in claim 1, wherein said new control capability is an ability of selecting an address.

4. The method defined in claim 1, wherein said new control capability is an ability of controlling functions.

5. The method defined in claim 1, wherein said new control capability is an ability of forming locomotive consists.

6. The method defined in claim 1, wherein said direct current control device is a direct current power pack that is configured for controlling direct current motor locomotives.

7. The method defined in claim 1, wherein said conversion interface includes a means of input voltage attenuation.

8. The method defined in claim 1, wherein said conversion interface further include a means of forming a zero bias offset voltage.

9. The method defined in claim 1, wherein said conversion interface includes a means of forming an input voltage guard band for ensuring reliable stop and direction change conditions.

10. The method defined in claim 1, wherein said conversion interface includes a means for automatically discriminating between direct current input voltages and alternating current input voltages.

11. A method for providing a new control capability to an alternating current control device without said new control capability, and said alternating current control device being connected to a model railroad control system, said method comprising the steps of:

providing said alternating current control device without said new control capability, and said alternating current control device including a speed control means, a direction control means that encodes a direction by a predefined time sequenced variation of output voltage of said alternating current control device, connecting said output voltage to a conversion interface means for detecting and processing said output voltage, transmitting the detected and processed output voltage from said conversion interface means to a throttle user interface means that is capable of performing said new control capability, exporting said new control capability from said throttle user interface means to said alternating current control device so as to transform said alternating current control device into a conversion throttle that is capable of performing said new control capability.

12. The method defined in claim 11, wherein said step of exporting is initiated by an export select means.

13. The method defined in claim 11, wherein said new control capability is an ability of controlling functions.

14. The method defined in claim 11, wherein said new control capability is an ability of forming locomotive consists.

15. The method defined in claim 11, wherein said alternating current control device is an alternating current power pack that is configured for controlling alternating current motor locomotives.

16. The method defined in claim 11, wherein said new control capability is an ability to select any address that is available to decoders in locomotives and that is operable with a control voltage encoding method.

* * * * *